US005937607A

United States Patent [19]

Li

[11] Patent Number: 5,937,607

[45] Date of Patent: Aug. 17, 1999

[54] WALL FRAME ASSEMBLY

[76] Inventor: Hsiu-Ling Li, 58, Ma Yuan West St., Taichung, Taiwan

[21] Appl. No.: 08/910,582

[22] Filed: Jul. 26, 1997

[30] Foreign Application Priority Data

Sep. 7, 1996 [TW] Taiwan ..... 85213814

[51] Int. Cl.[6] ..... E04C 2/38

[52] U.S. Cl. ..... 52/656.1; 52/348; 52/481.1

[58] Field of Search ..... 52/653.1, 656.1, 52/348, 481.1

[56] References Cited

U.S. PATENT DOCUMENTS

| | | | |
|---|---|---|---|
| 4,016,698 | 4/1977 | Rogers | 52/656.1 |
| 4,074,487 | 2/1978 | Daniels et al. | 52/236.3 |
| 4,130,970 | 12/1978 | Cable | 52/236.3 |
| 4,563,851 | 1/1986 | Long | 52/656.1 |

*Primary Examiner*—Carl D. Friedman
*Assistant Examiner*—Beth Aubrey

[57] ABSTRACT

A wall frame assembly has an upper main beam, a lower main beam, a first lateral beam device, and a second lateral beam device. A first, a second, a third and a fourth angle plates are disposed on fourth inner corners among the upper main beam, the first lateral beam device, the second lateral beam device, and the lower main beam. A first angle blocking plate is disposed on the first angle plate. A second angle blocking plate is disposed on the second angle plate. A third angle blocking plate is disposed on the third angle plate. A fourth angle blocking plate is disposed on the fourth angle plate. A main support frame is disposed between the second angle blocking plate and the third angle blocking plate. A first auxiliary support frame is disposed between the main support frame and the first angle blocking plate. A second auxiliary support frame is disposed between the main support frame and the fourth angle blocking plate.

8 Claims, 7 Drawing Sheets

WALL FRAME ASSEMBLY

BACKGROUND OF THE INVENTION

The present invention relates to a wall frame assembly. More particularly, the present invention relates to a wall frame assembly which has a high stress while in construction.

A conventional wall frame assembly has an upper main beam, a lower main beam, a left beam, and a right beam disposed between an inner wall and an outer wall. However, the stress of the conventional wall frame assembly is very poor. An earthquake or a strong typhoon may destroy the conventional wall frame assembly easily. If the conventional wall frame assembly is not destroyed, it will be twisted because the torsibility of the conventional wall frame assembly is very poor.

SUMMARY OF THE INVENTION

An object of the present invention is to provide a wall frame assembly which has a high stress while in construction.

Another object of the present invention is to provide a wall frame assembly which has four angle plates to reinforce the stress of the wall frame assembly.

Another object of the present invention is to provide a wall frame assembly which has four angle blocking plates to reinforce the stress of the wall frame assembly.

Another object of the present invention is to provide a wall frame assembly which can be converted to a corner frame assembly to be disposed between an inner wall and an outer wall in order to reinforce the stress of a corner.

Accordingly, a wall frame assembly comprises an upper main beam, a lower main beam, a first lateral beam device disposed between the upper main beam and the lower main beam, a second lateral beam device disposed between the upper main beam and the lower main beam, a first angle plate disposed on a first inner corner between the upper main beam and the first lateral beam device, a second angle plate disposed on a second inner corner between the upper main beam and the second lateral beam device, a third angle plate disposed on a third inner corner between the lower main beam and the first lateral beam device, a fourth angle plate disposed on a fourth inner corner between the lower main beam and the second lateral beam device, a first angle blocking plate disposed on the first angle plate, a second angle blocking plate disposed on the second angle plate, a third angle blocking plate disposed on the third angle plate, a fourth angle blocking plate disposed on the fourth angle plate, a main support frame disposed between the second angle blocking plate and the third angle blocking plate, a first auxiliary support frame disposed between the main support frame and the first angle blocking plate, and a second auxiliary support frame disposed between the main support frame and the fourth angle blocking plate. The main support frame, the first auxiliary support frame, and the second auxiliary support frame are arranged in an X shape.

BRIEF DESCRIPTION OF THE DRAWINGS

FIG. 1A is a perspective exploded view of a wall frame assembly of a preferred embodiment in accordance with the present invention;

DETAILED DESCRIPTION OF THE INVENTION

Figure 1:
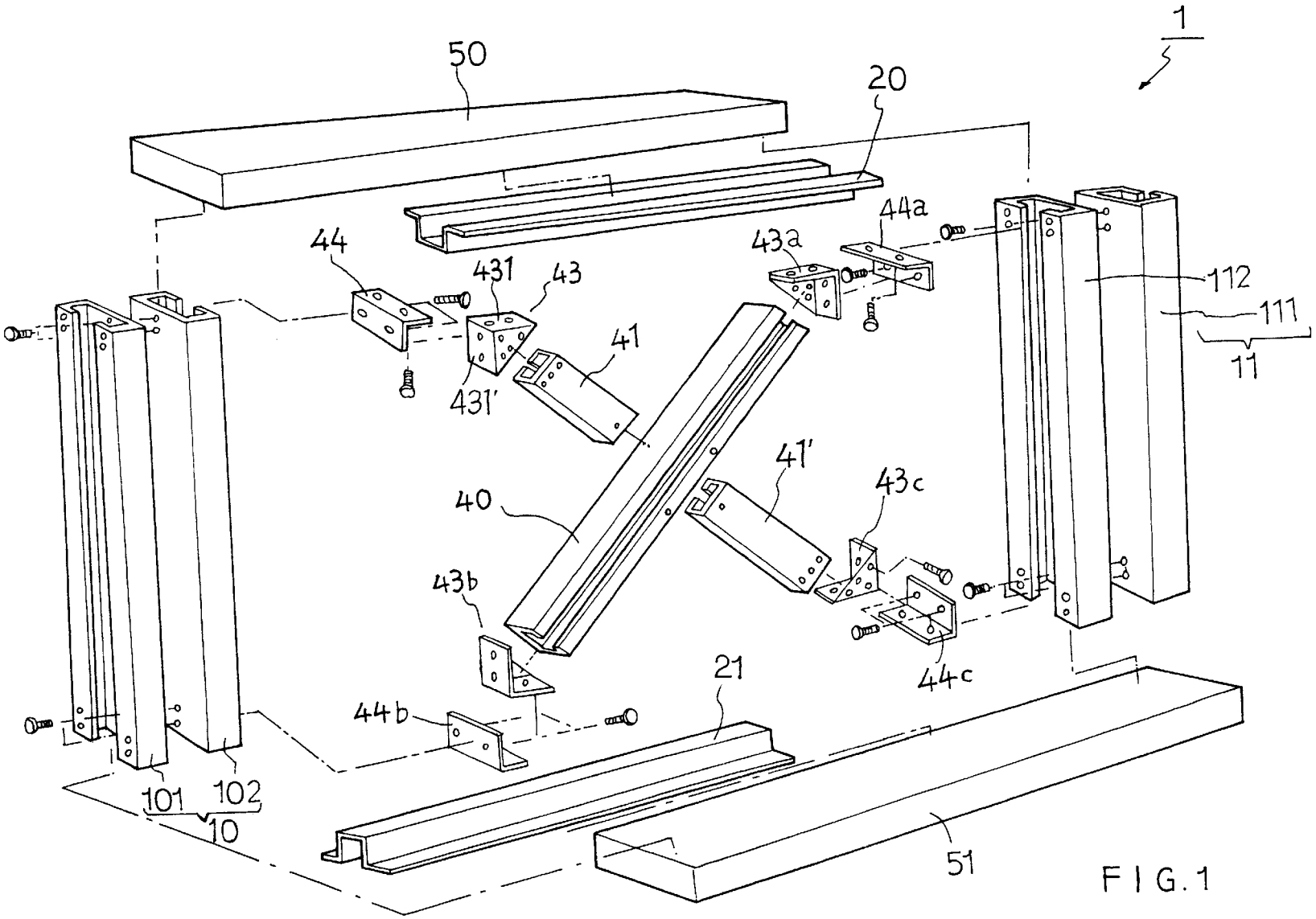
FIG. 1 is a partially perspective exploded view of a wall frame assembly of a preferred embodiment in accordance with the present invention.
Figure 2:
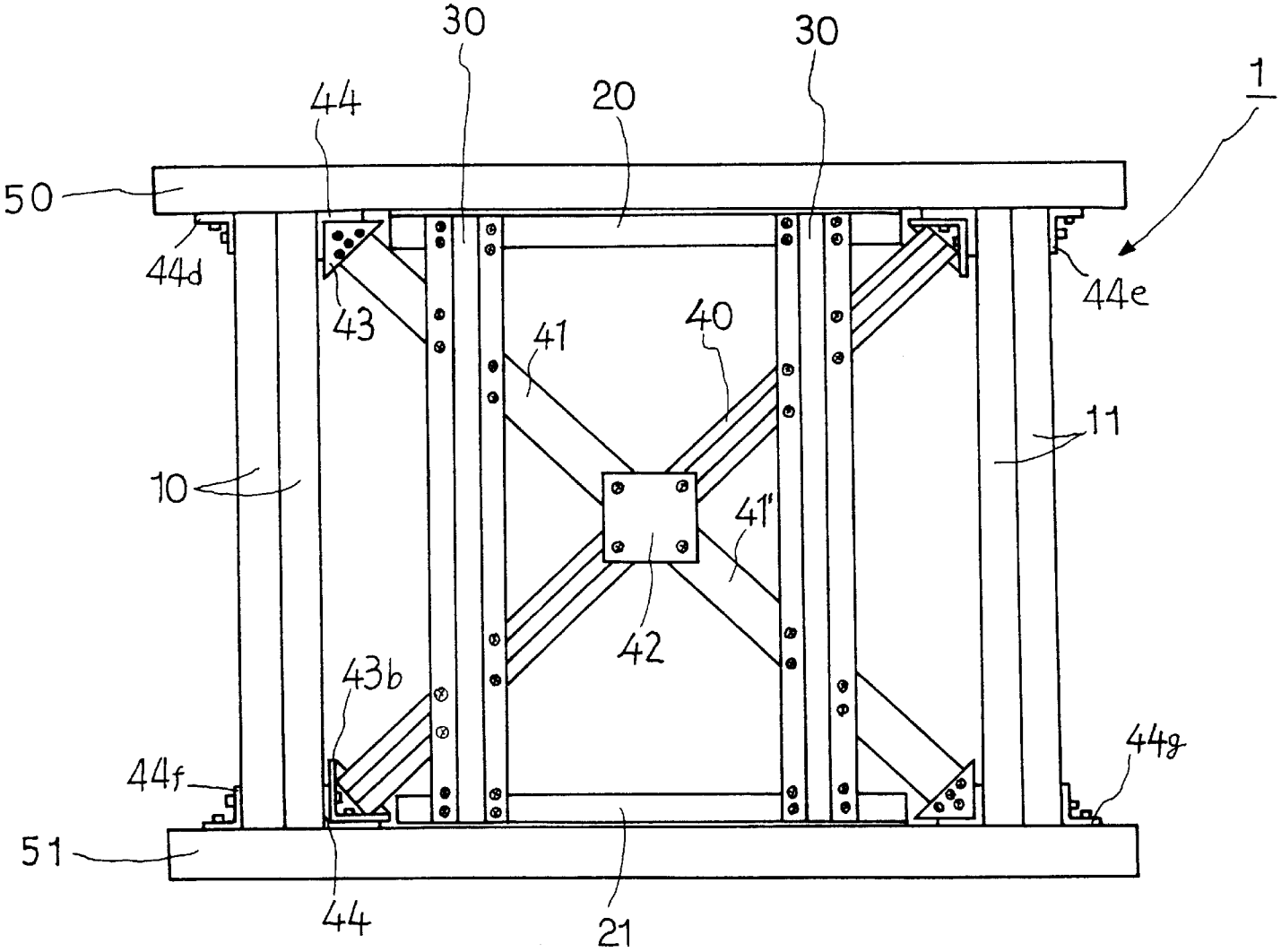
FIG. 2 is an elevational assembly view of a wall frame assembly of a preferred embodiment in accordance with the present invention.
Figure 3:
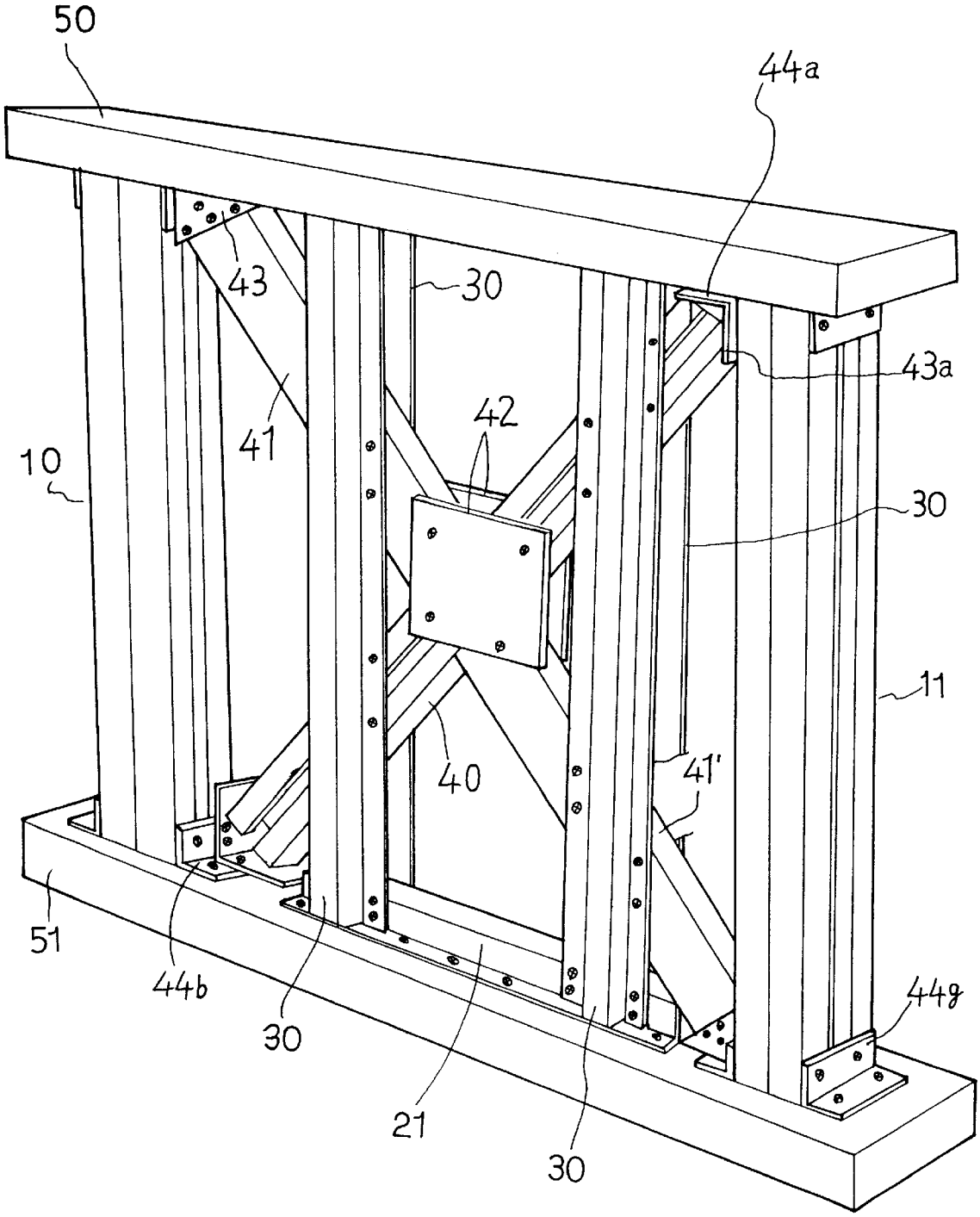
FIG. 3 is a perspective assembly view of a wall frame assembly of a preferred embodiment in accordance with the present invention.
Figure 4:
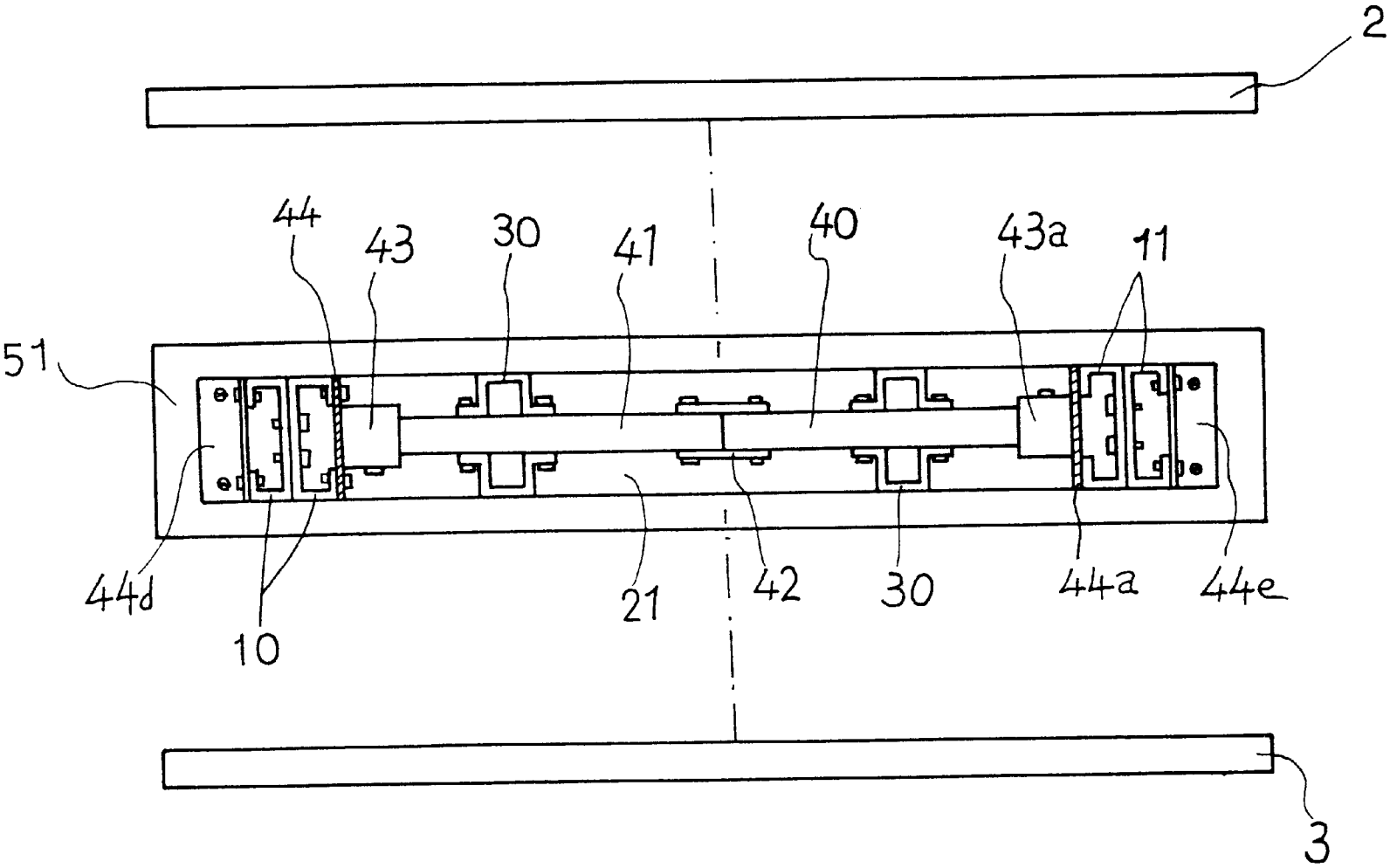
FIG. 4 is a top plan view of a wall frame assembly without an upper main beam and an upper rail beam.

Referring to FIGS. 1 to 4, a wall frame assembly 1 comprises an upper main beam 50, a lower main beam 51, a first lateral beam device 10 disposed between the upper main beam 50 and the lower main beam 51, a second lateral beam device 11 disposed between the upper main beam 50 and the lower main beam 51, a first angle plate 44 disposed on a first inner corner between the upper main beam 50 and the first lateral beam device 10, a second angle plate 44*a* disposed on a second inner corner between the upper main beam 50 and the second lateral beam device 11, a third angle plate 44*b* disposed on a third inner corner between the lower main beam 51 and the first lateral beam device 10, a fourth angle plate 44*c* disposed on a fourth inner corner between the lower main beam 51 and the second lateral beam device 11, a first angle blocking plate 43 disposed on the first angle plate 44*a*, a second angle blocking plate 43*a* disposed on the second angle plate 44, a third angle blocking plate 43*b* disposed on the third angle plate 44*b*, a fourth angle blocking plate 43*c* disposed on the fourth angle plate 44*c*, a main support frame 40 disposed between the second angle blocking plate 43*a* and the third angle blocking plate 43*b*, a first auxiliary support frame 41 disposed between the main support frame 40 and the first angle blocking plate 43, and a second auxiliary support frame 41 ' disposed between the main support frame 40 and the fourth angle blocking plate 43*c*. The main support frame 40, the first auxiliary support frame 41 ', and the second auxiliary support frame 41 are arranged in an X shape.

The wall frame assembly 1 further comprises a fifth angle plate 44*d*, disposed on a first outer corner between the upper main beam 50 and the first lateral beam device 10, a sixth angle plate 44*e* disposed on a second outer corner between the upper main beam 50 and the second lateral beam device 11, a seventh angle plate 44*f* disposed on a third outer corner between the lower main beam 51 and the first lateral beam device 10, and an eighth angle plate 44*g* disposed on a fourth outer corner between the lower main beam 51 and the second lateral beam device 11.

The first lateral beam device 10 has two parallel left beams 101 and 102 adjacent together. The second lateral beam device 11 has two parallel right beams 111 and 112 adjacent together.

An upper rail beam 20 is disposed on the upper main beam 50. A lower rail beam 21 is disposed on the lower main beam 51. Two positioning plates 42 are disposed on two opposite middle sides of the main support frame 40. A plurality of auxiliary beams 30 are disposed between the upper main beam 50 and the lower main beam 51. Each of the angle blocking plates 43, 43*a*, 43*b*, 43*c* has a first arm plate 431 and a second arm plate 431'.

Figure 5:
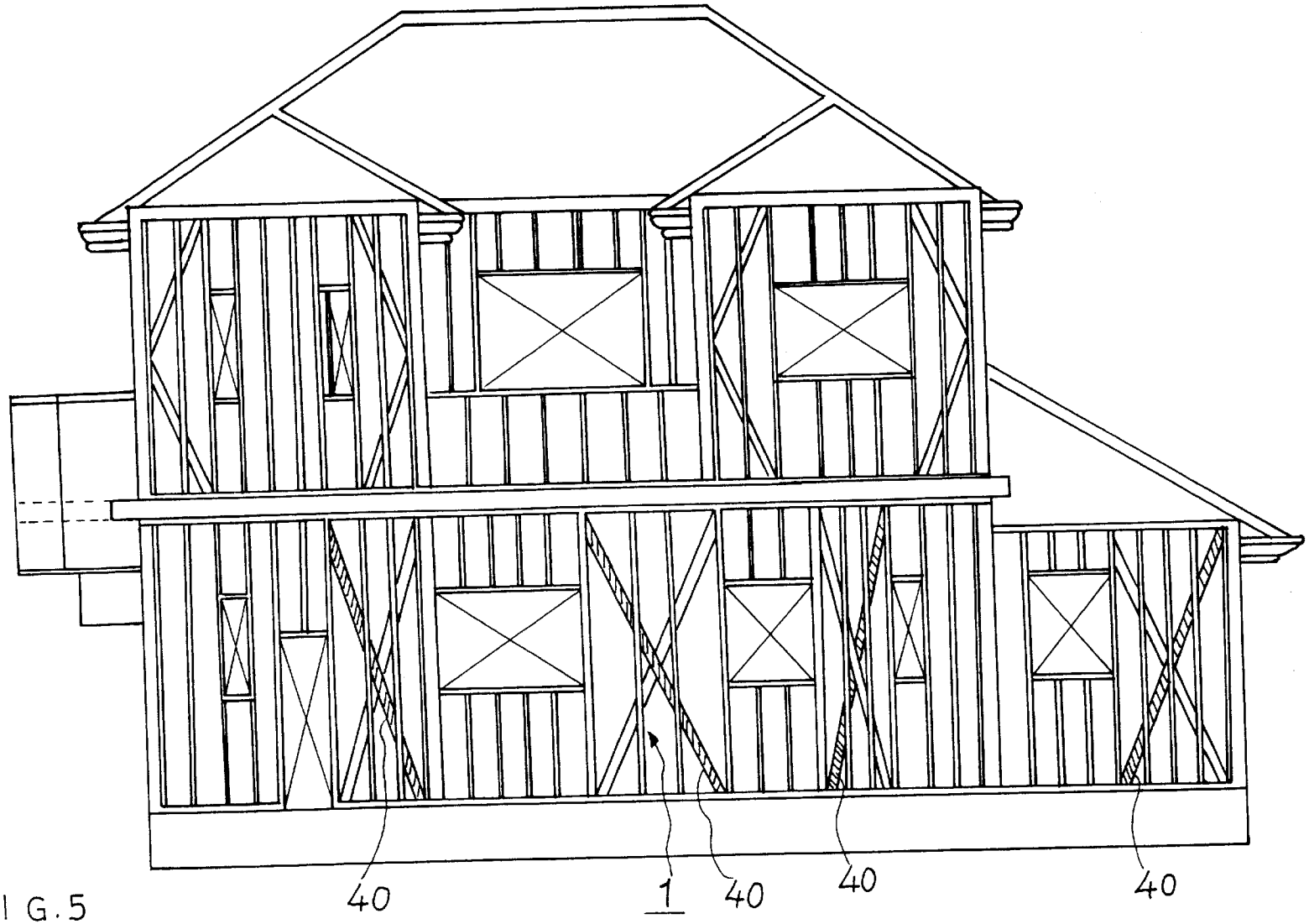
FIG. 5 is a schematic view illustrating an application of a wall frame assembly for a combination house.

Referring to FIG. 5, a plurality of the wall frame assemblies 1 can be combined together for a combination house.

Figure 6:
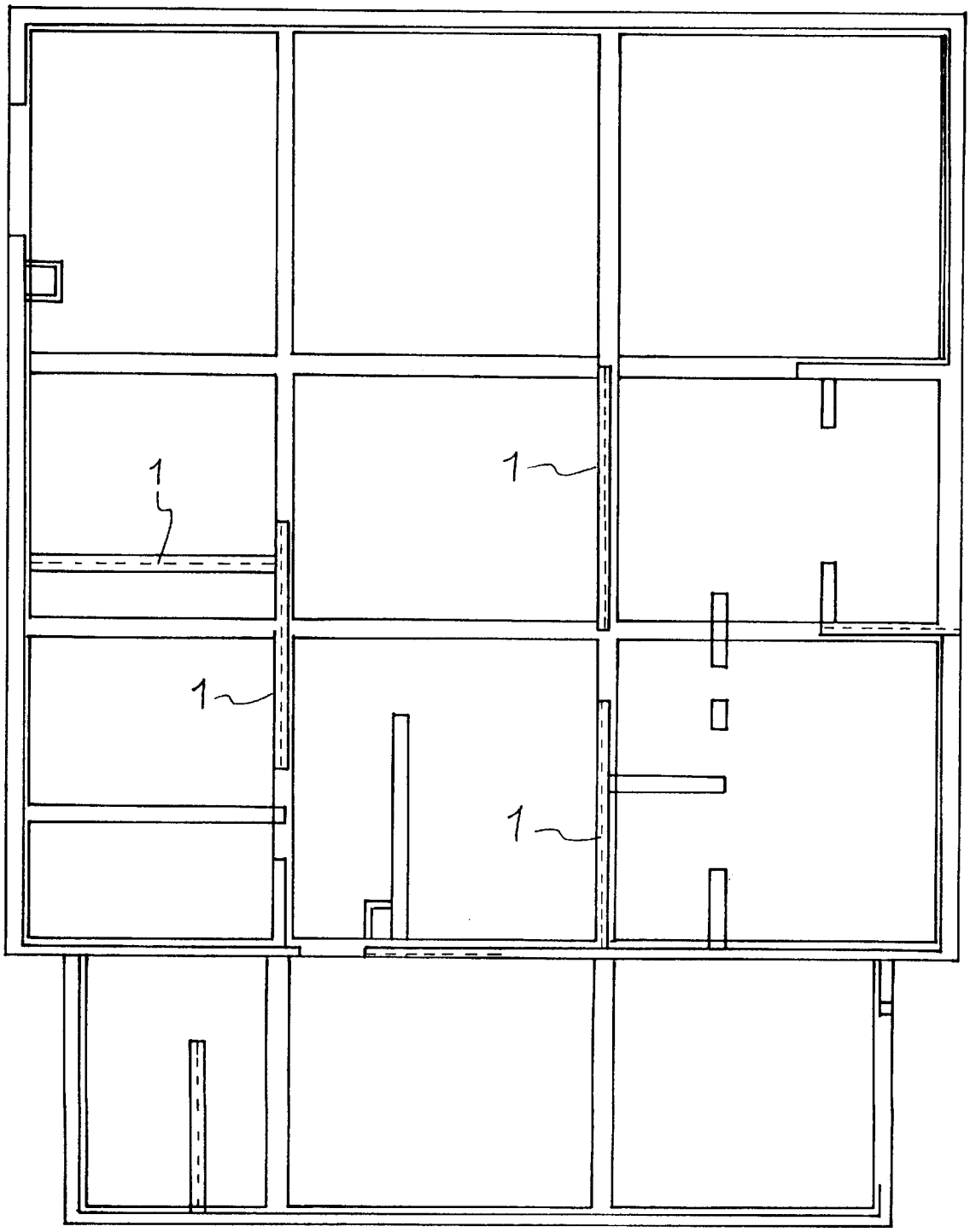
FIG. 6 is a schematic view illustrating an application of a wall frame assembly as a separation wall.

Referring to FIG. 6, the wall frame assembly can be used as a separation wall.

Figure 7:
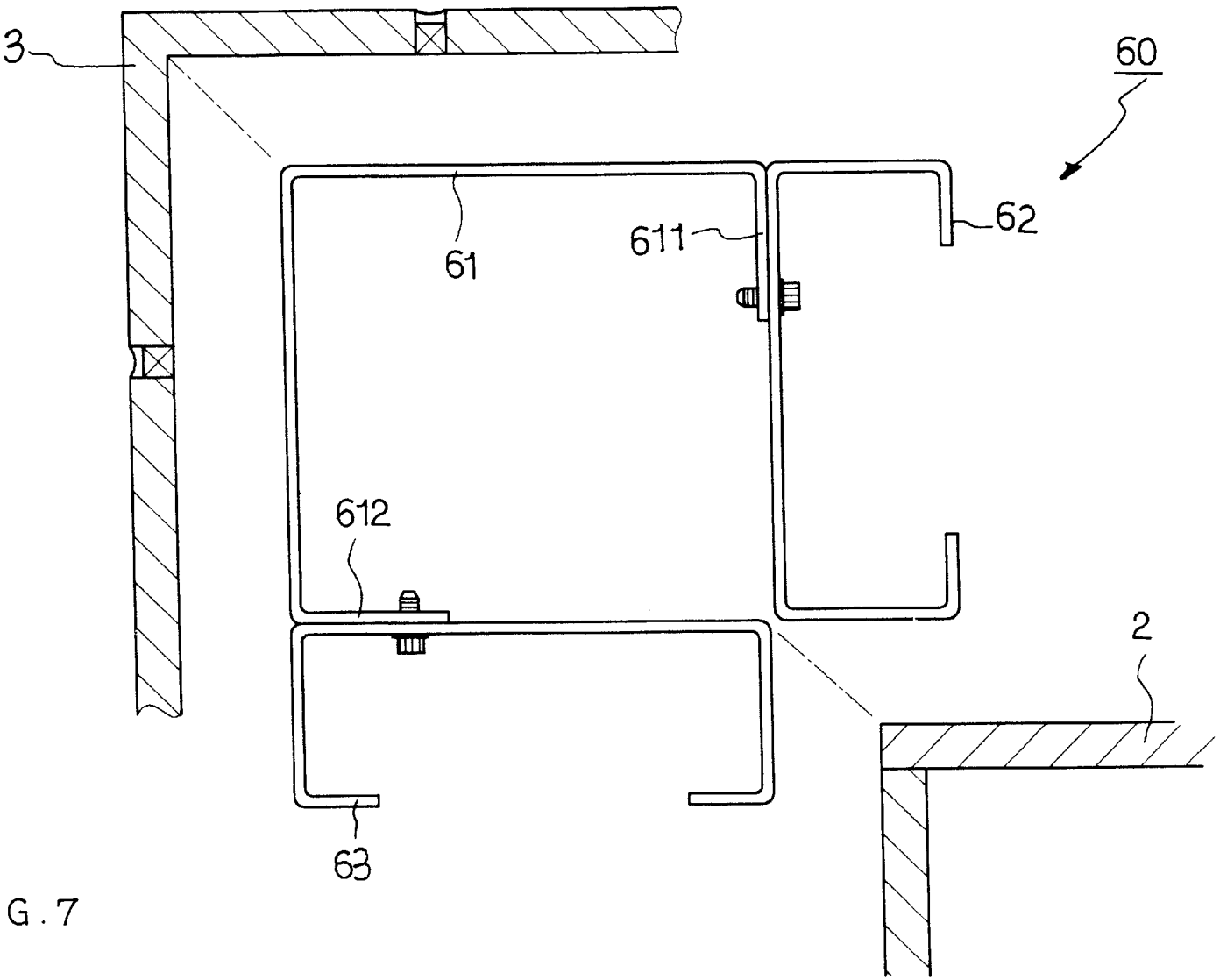
FIG. 7 is a sectional view illustrating an application of a corner frame assembly in a corner of a house.

Referring to FIG. 7, a corner frame assembly 60 has a first beam 62 (the same as the left beam 101), a second beam 63 (the same as the right beam 111), and a main corner frame 61 having a first extended plate 611 abutting the first beam 62 and a second extended plate 612 abutting the second beam 63. At least a bolt fastens the first extended plate 611 and the first beam 62. At least a bolt fastens the second extended plate 612 and the second beam 63. The corner frame assembly 60 is disposed between a corner of an inner wall 2 and a corner of an outer wall 3.

The present invention has the following advantages.

The wall frame assembly has a high stress while in construction.

The wall frame assembly has a plurality of angle plates to reinforce the stress of the wall frame assembly.

The wall frame assembly has a plurality of angle blocking plates to reinforce the stress of the wall frame assembly.

The corner frame assembly can be disposed between an inner wall and an outer wall in order to reinforce the stress of a corner.

The invention is not limited to the above embodiment but various modification thereof may be made. Further, various changes in form and detail may be made without departing from the scope of the invention.

I claim:

1. A wall frame assembly comprising:

an upper main beam, a lower main beam, a first lateral beam device disposed between the upper main beam and the lower main beam, and a second lateral beam device disposed between the upper main beam and the lower main beam, a first angle plate disposed on a first inner corner between the upper main beam and the first lateral beam device, a second angle plate disposed on a second inner corner between the upper main beam and the second lateral beam device, a third angle plate disposed on a third inner corner between the lower main beam and the first lateral beam device, a fourth angle plate disposed on a fourth inner corner between the lower main beam and the second lateral beam device, a first angle blocking plate disposed on the first angle plate, a second angle blocking plate disposed on the second angle plate, a third angle blocking plate disposed on the third angle plate, a fourth angle blocking plate disposed on the fourth angle plate, a main support frame disposed between the second angle blocking plate and the third angle blocking plate, a first auxiliary support frame disposed between the main support frame and the first angle blocking plate, a second auxiliary support frame disposed between the main support frame and the fourth angle blocking plate, and the main support frame, the first auxiliary support frame, and the second auxiliary support frame arranged in an X shape.

2. The wall frame assembly as claimed in claim 1, wherein the wall frame assembly further comprises a fifth angle plate disposed on a first outer corner between the upper main beam and the first lateral beam device, a sixth angle plate disposed on a second outer corner between the upper main beam and the second lateral beam device, a seventh angle plate disposed on a third outer corner between the lower main beam and the first lateral beam device, and an eighth angle plate disposed on a fourth outer corner between the lower main beam and the second lateral beam device, and wherein the fifth thru eight plates are the opposite side of the first thru fourth plates.

3. The wall frame assembly as claimed in claim 1, wherein the first lateral beam device has two adjacent left beams.

4. The wall frame assembly as claimed in claim 1, wherein the second lateral beam device has two adjacent right beams.

5. The wall frame assembly as claimed in claim 1, wherein an upper rail beam is disposed on the upper main beam.

6. The wall frame assembly as claimed in claim 1, wherein a lower rail beam is disposed on the lower main beam.

7. The wall frame assembly as claimed in claim 1, wherein the main support frame has two opposites sides, and two positioning plates are disposed on two opposite middle sides of the main support frame.

8. The wall frame assembly as claimed in claim 1, wherein a plurality of auxiliary beams are disposed between the upper main beam and the lower main beam.

* * * * *